US009140455B2

(12) United States Patent
Stoia et al.

(10) Patent No.: US 9,140,455 B2
(45) Date of Patent: Sep. 22, 2015

(54) FLOWSLEEVE OF A TURBOMACHINE COMPONENT

(75) Inventors: Lucas John Stoia, Taylors, SC (US); Russell Pierson DeForest, Simpsonville, SC (US); Patrick Benedict Melton, Horse Shoe, NC (US)

(73) Assignee: General Electric Company, Schenectady, NY (US)

( * ) Notice: Subject to any disclaimer, the term of this patent is extended or adjusted under 35 U.S.C. 154(b) by 766 days.

(21) Appl. No.: 13/343,200

(22) Filed: Jan. 4, 2012

(65) Prior Publication Data

US 2013/0167542 A1 Jul. 4, 2013

(51) Int. Cl.

| | |
|---|---|
| ***F23R 3/28*** | (2006.01) |
| ***F23R 3/34*** | (2006.01) |
| ***F23R 3/54*** | (2006.01) |

(52) U.S. Cl.

CPC ..... *F23R 3/286* (2013.01); *F23R 3/346* (2013.01); *F23R 3/54* (2013.01)

(58) Field of Classification Search

CPC ..... F23R 3/002; F23R 3/005; F23R 3/04; F23R 3/045; F23R 3/06; F23R 3/08; F23R 3/10; F23R 3/12; F23R 3/14; F23R 3/16; F23R 3/28; F23R 3/283; F23R 3/286; F23R 3/34; F23R 3/44; F23R 3/46; F23R 3/50; F23R 3/54; F02C 7/22; F02C 7/222; F02C 7/228

USPC ..... 60/737, 738, 739, 746, 752, 760

See application file for complete search history.

(56) References Cited

U.S. PATENT DOCUMENTS

| | | | | |
|---|---|---|---|---|
| 3,055,179 | A | | 9/1962 | Lefebvre et al. |
| 3,099,134 | A | | 7/1963 | Calder et al. |
| 3,872,664 | A | | 3/1975 | Lohmann et al. |
| 3,924,576 | A | | 12/1975 | Siewert |
| 3,934,409 | A | | 1/1976 | Quillevere et al. |
| 4,028,888 | A | | 6/1977 | Pilarczyk |
| 4,192,139 | A | | 3/1980 | Buchheim |
| 4,236,378 | A | | 12/1980 | Vogt |
| 4,265,615 | A | | 5/1981 | Lohmann et al. |
| 4,271,674 | A | | 6/1981 | Marshall et al. |
| 4,420,929 | A | | 12/1983 | Jorgensen et al. |
| 4,426,841 | A | * | 1/1984 | Cornelius et al. ..... 60/39.23 |
| 4,543,894 | A | | 10/1985 | Griswold et al. |

(Continued)

FOREIGN PATENT DOCUMENTS

| | | |
|---|---|---|
| EP | 0803682 A2 | 10/1997 |
| EP | 2161500 A1 | 3/2010 |

OTHER PUBLICATIONS

Search Report and Written Opinion from EP Application No. 12198319.1 dated Jul. 30, 2013.

(Continued)

*Primary Examiner* — Phutthiwat Wongwian
*Assistant Examiner* — Michael B Mantyla

(57) ABSTRACT

A flowsleeve of a turbomachine component is provided. The flowsleeve includes an annular body including an upstream casing and a downstream casing. The upstream casing defines a fuel feed, and the downstream casing defines an airway opening, and a premixing passage. The premixing passage is fluidly coupled to the fuel feed and the airway opening and has a passage interior in which fuel and air receivable from the fuel feed and the airway opening, respectively, are combinable to form a fuel and air mixture.

18 Claims, 1 Drawing Sheet

(56) References Cited

U.S. PATENT DOCUMENTS

| | | | | | |
|---|---|---|---|---|---|
| 4,590,769 | A | | 5/1986 | Lohmann et al. | |
| 4,603,548 | A | | 8/1986 | Ishibashi et al. | |
| 4,872,312 | A | | 10/1989 | Iizuka et al. | |
| 4,898,001 | A | | 2/1990 | Kuroda et al. | |
| 4,928,481 | A | | 5/1990 | Joshi et al. | |
| 4,955,191 | A | | 9/1990 | Okamoto et al. | |
| 4,989,549 | A | | 2/1991 | Korenberg | |
| 4,998,410 | A | | 3/1991 | Martinez-Leon et al. | |
| 5,033,263 | A | * | 7/1991 | Shekleton et al. | 60/800 |
| 5,054,280 | A | | 10/1991 | Ishibashi et al. | |
| 5,076,229 | A | | 12/1991 | Stanley | |
| 5,099,644 | A | | 3/1992 | Sabla et al. | |
| 5,127,229 | A | | 7/1992 | Ishibashi et al. | |
| 5,140,808 | A | * | 8/1992 | Shekleton et al. | 60/804 |
| 5,259,184 | A | | 11/1993 | Borkowicz et al. | |
| 5,274,991 | A | | 1/1994 | Fitts | |
| 5,319,935 | A | * | 6/1994 | Toon et al. | 60/733 |
| 5,323,600 | A | | 6/1994 | Munshi | |
| 5,350,293 | A | | 9/1994 | Khinkis et al. | |
| 5,394,688 | A | | 3/1995 | Amos | |
| 5,408,825 | A | | 4/1995 | Foss et al. | |
| 5,450,725 | A | | 9/1995 | Takahara et al. | |
| 5,475,979 | A | * | 12/1995 | Oag et al. | 60/737 |
| 5,479,782 | A | | 1/1996 | Parker et al. | |
| 5,481,866 | A | | 1/1996 | Mowill | |
| 5,518,395 | A | | 5/1996 | Maughan | |
| 5,619,855 | A | * | 4/1997 | Burrus | 60/736 |
| 5,623,819 | A | | 4/1997 | Bowker et al. | |
| 5,628,192 | A | * | 5/1997 | Hayes-Bradley et al. | 60/733 |
| 5,638,674 | A | | 6/1997 | Mowill | |
| 5,640,851 | A | * | 6/1997 | Toon et al. | 60/737 |
| 5,647,215 | A | | 7/1997 | Sharifi et al. | |
| 5,657,632 | A | | 8/1997 | Foss | |
| 5,687,571 | A | | 11/1997 | Althaus et al. | |
| 5,749,218 | A | | 5/1998 | Cromer et al. | |
| 5,749,219 | A | | 5/1998 | DuBell | |
| 5,802,854 | A | | 9/1998 | Maeda et al. | |
| 5,826,429 | A | | 10/1998 | Beebe et al. | |
| 5,829,967 | A | | 11/1998 | Chyou | |
| 5,850,731 | A | | 12/1998 | Beebe et al. | |
| 5,878,566 | A | | 3/1999 | Endo et al. | |
| 6,047,550 | A | | 4/2000 | Beebe | |
| 6,092,363 | A | | 7/2000 | Ryan | |
| 6,182,451 | B1 | | 2/2001 | Hadder | |
| 6,192,688 | B1 | | 2/2001 | Beebe | |
| 6,201,029 | B1 | | 3/2001 | Waycuilis | |
| 6,240,732 | B1 | * | 6/2001 | Allan | 60/739 |
| 6,270,338 | B1 | * | 8/2001 | Eroglu et al. | 431/8 |
| 6,289,851 | B1 | | 9/2001 | Rabovitser et al. | |
| 6,343,462 | B1 | | 2/2002 | Drnevich et al. | |
| 6,415,608 | B1 | | 7/2002 | Newburry | |
| 6,418,725 | B1 | | 7/2002 | Maeda et al. | |
| 6,513,334 | B2 | * | 2/2003 | Varney | 60/776 |
| 6,609,493 | B2 | | 8/2003 | Yamaguchi et al. | |
| 6,663,380 | B2 | | 12/2003 | Rabovitser et al. | |
| 6,705,117 | B2 | | 3/2004 | Simpson et al. | |
| 6,732,527 | B2 | * | 5/2004 | Freeman et al. | 60/737 |
| 6,775,987 | B2 | | 8/2004 | Sprouse et al. | |
| 6,868,676 | B1 | | 3/2005 | Haynes | |
| 6,959,550 | B2 | * | 11/2005 | Freeman et al. | 60/725 |
| 7,040,094 | B2 | | 5/2006 | Fischer et al. | |
| 7,082,770 | B2 | | 8/2006 | Martling et al. | |
| 7,149,632 | B1 | | 12/2006 | Gao et al. | |
| 7,162,875 | B2 | * | 1/2007 | Fletcher et al. | 60/773 |
| 7,185,497 | B2 | | 3/2007 | Dudebout et al. | |
| 7,198,483 | B2 | | 4/2007 | Bueche et al. | |
| 7,302,801 | B2 | | 12/2007 | Chen | |
| 7,303,388 | B2 | | 12/2007 | Joshi et al. | |
| 7,685,823 | B2 | | 3/2010 | Martling et al. | |
| 7,707,835 | B2 | | 5/2010 | Lipinski et al. | |
| 7,757,491 | B2 | | 7/2010 | Hessler | |
| 8,539,773 | B2 | * | 9/2013 | Ziminsky et al. | 60/737 |
| 8,726,666 | B2 | * | 5/2014 | Kendrick | 60/737 |
| 2001/0049932 | A1 | | 12/2001 | Beebe | |
| 2003/0010035 | A1 | | 1/2003 | Farmer et al. | |
| 2003/0024234 | A1 | | 2/2003 | Holm et al. | |
| 2003/0145576 | A1 | * | 8/2003 | Scarinci et al. | 60/39.37 |
| 2006/0107667 | A1 | * | 5/2006 | Haynes et al. | 60/776 |
| 2007/0234733 | A1 | | 10/2007 | Harris et al. | |
| 2008/0072599 | A1 | | 3/2008 | Morenko et al. | |
| 2008/0264033 | A1 | | 10/2008 | Lacy et al. | |
| 2009/0084082 | A1 | | 4/2009 | Martin et al. | |
| 2010/0018208 | A1 | | 1/2010 | Ritland | |
| 2010/0170216 | A1 | | 7/2010 | Venkataraman et al. | |
| 2010/0170219 | A1 | | 7/2010 | Venkataraman et al. | |
| 2010/0170251 | A1 | | 7/2010 | Davis, Jr. et al. | |
| 2010/0170252 | A1 | | 7/2010 | Venkataraman et al. | |
| 2010/0170254 | A1 | | 7/2010 | Venkataraman et al. | |
| 2010/0174466 | A1 | | 7/2010 | Davis, Jr. et al. | |
| 2014/0165577 | A1 | * | 6/2014 | Melton et al. | 60/772 |

OTHER PUBLICATIONS

U.S. Appl. No. 13/153,944, filed June 6, 2011.

* cited by examiner

FLOWSLEEVE OF A TURBOMACHINE COMPONENT

BACKGROUND OF THE INVENTION

The subject matter disclosed herein relates to a flowsleeve of a turbomachine component.

A turbomachine, such as a gas turbine engine, may include a compressor, a combustor and a turbine. The compressor compresses inlet air and the combustor combusts the compressed inlet air along with fuel to produce a fluid flow of high temperature fluids. Those high temperature fluids are directed to the turbine where the energy of the high temperature fluids is converted into mechanical energy that can be used to generate power and/or electricity. The turbine is formed to define an annular pathway through which the high temperature fluids pass.

Often, the combustion occurring within the combustor produces pollutants and other undesirable products, such as oxides of nitrogen (NOx), which are exhausted into the atmosphere from the turbine. Recently, however, efforts have been undertaken to reduce the production of such pollutants. These efforts have included the introduction of axially staging fuel injection within the combustor and/or other types of late lean injection (LLI) systems.

BRIEF DESCRIPTION OF THE INVENTION

According to one aspect of the invention, a flowsleeve of a turbomachine component is provided. The flowsleeve includes an annular body including an upstream casing and a downstream casing. The upstream casing defines a fuel feed, and the downstream casing defines an airway opening, and a premixing passage. The premixing passage is fluidly coupled to the fuel feed and the airway opening and has a passage interior in which fuel and air receivable from the fuel feed and the airway opening, respectively, are combinable to form a fuel and air mixture.

According to another aspect of the invention, a turbomachine component is provided and includes a first vessel having an upstream end defining a first interior in which combustion occurs and a downstream end defining a second interior through which products of the combustion flow, a second vessel configured to be disposed about the downstream end of the first vessel, the second vessel defining a fuel feed, an airway opening and a premixing passage fluidly coupled to the fuel feed and the airway opening and having a passage interior in which fuel and air receivable from the fuel feed and the airway opening, respectively, are combinable to form a fuel and air mixture and an injector coupled to the premixing passage and configured to transport the fuel and air mixture to the second interior.

According to yet another aspect of the invention, a turbomachine component is provided and includes a first vessel having an upstream end defining a first interior in which combustion occurs and a downstream end defining a second interior through which products of the combustion flow, a second vessel configured to be disposed about the downstream end of the first vessel, the second vessel defining at multiple circumferential locations a fuel feed, an airway opening, a premixing passage fluidly coupled to the fuel feed and the airway opening and having a passage interior in which fuel and air receivable from the fuel feed and the airway opening, respectively, are combinable downstream from the airway opening to form a fuel and air mixture, and a plenum at a downstream end of the premixing passage and multiple injectors, each of the multiple injectors being coupled to the plenum and configured to transport the fuel and air mixture to the second interior.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

In accordance with aspects, a flowsleeve is provided for an axially staged or late lean injection (LLI) system that is coupled with micromixer injection technology to deliver partially or fully premixed fuel and air mixtures to a flowsleeve mounted injector. To this end, a combination of fuel and air passages are machined, drilled and/or cut into the flowsleeve walls such that an axial length of the flowsleeve draws compressor discharge (CDC) air inwardly from an exterior of the flowsleeve and through airway openings. This CDC air is then delivered to the injector along with fuel with which it has been mixed along the length of the flowsleeve. The configuration may ultimately result in overall reductions of emissions of oxides of nitrogen (NOx).

Figure 1:
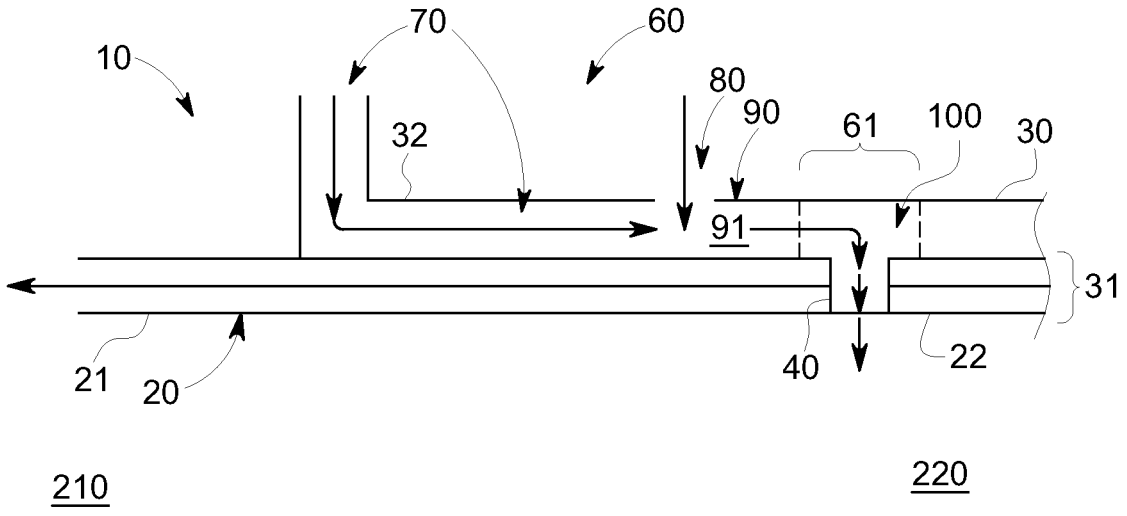
FIG. 1 is a side view of a turbomachine component.
Figure 2:
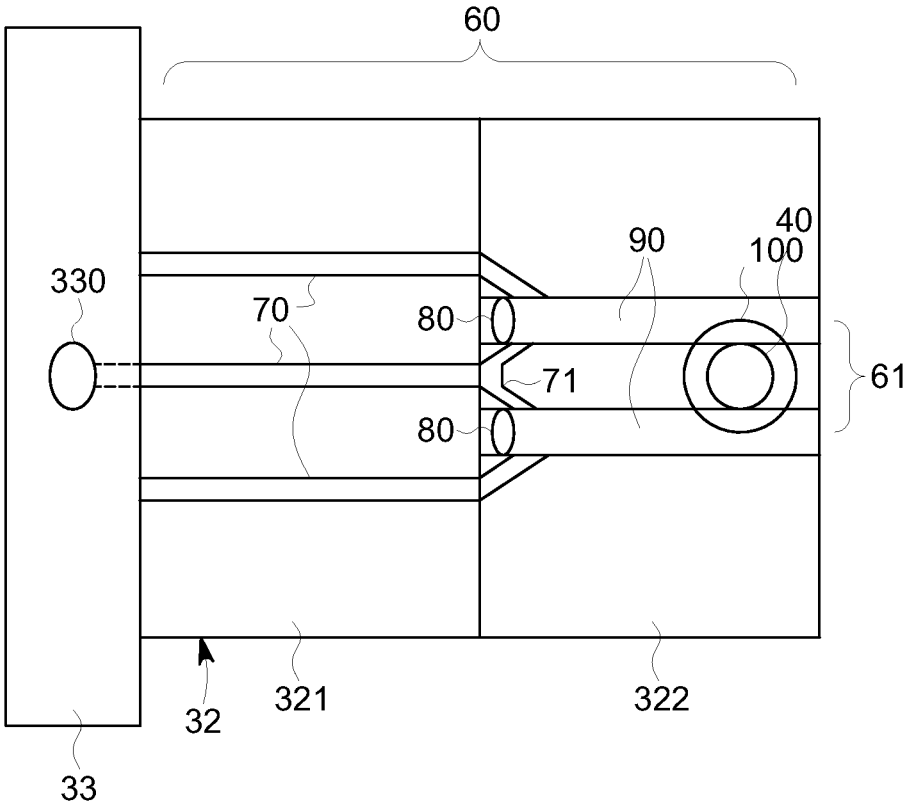
FIG. 2 is a radial view of the turbomachine component.

With reference to FIGS. 1 and 2, a turbomachine component 10 is provided as, for example, a downstream section of a combustor in a gas turbine engine. The turbomachine component 10 includes a first vessel 20, such as a combustor liner, a second vessel 30, such as a combustor flowsleeve and one or multiple injectors 40 that are mounted to the second vessel 30 in an axially staged or late lean injection (LLI) system.

The first vessel 20 has an upstream end 21 and a downstream end 22. The upstream end 21 is formed to define a first interior 210 therein in which combustion of combustible materials, such as a fuel and air, occurs. The downstream end 22 is formed to define a second interior 220 downstream from the first interior 210 through which products of the combustion flow as a main flow toward a transition piece and/or a turbine section. The second vessel 30 is configured to be disposed about at least the downstream end 220 of the first vessel 20 to define an annulus 31 between an outer surface of the first vessel 20 and an inner surface of the second vessel 30. The annulus 31 may be formed to define a flow path for fluid moving toward the upstream end 21 of the first vessel 20 from the transition piece as impingement or cooling flow. Additional fluid/air may enter the annulus 31 in other manners as well.

The second vessel 30 defines one or multiple micromixing injection systems 60 at one or multiple circumferential locations 61 that may be arranged with uniform or non-uniform spacing. Each of the one or multiple micromixing injection systems 60 at each of the one or multiple circumferential locations 61 is defined to include at least one fuel feed 70, at least one airway opening 80, at least one premixing passage 90 and a least one plenum 100. For each micromixing injection system 60, the at least one premixing passage 90 is fluidly coupled to the at least one fuel feed 70 and the at least one airway opening 80 and has a passage interior 91 in which fuel and air, such as compressor discharge (CDC) air, which are respectively receivable from the at least one fuel feed 70 and the at least one airway opening 80, are combinable to form a fuel and air mixture. The at least one plenum 100 is defined at or near a downstream end of the at least one premixing passage 90.

The one or multiple injectors 40 are each disposed at corresponding one or multiple circumferential locations 61, respectively. With such a configuration, each multiple injector 40 may be coupled to a corresponding one of the plenums 100 and may be configured to extend radially inwardly from the second vessel 30 to traverse the annulus 31 and to transport the fuel and air mixture from the second vessel 30 toward the second interior 220 of the first vessel 20 such that the fuel and air mixture may be injected to and mixed with the main flow of the products of the combustion flowing toward the transition piece and/or the turbine section.

In accordance with embodiments, the second vessel 30 may include an annular body 32. The annular body 32 may include an upstream casing 321 and a downstream casing 322, which may be welded or otherwise fastened together. The upstream casing 321 is formed to define one to three or more fuel feeds 70 at each of the one or multiple circumferential locations 61. The downstream casing 322 is similarly formed to define at each of the one or multiple circumferential locations 61 a pair of airway openings 80, a pair of premixing passages 90 and a plenum 100. The second vessel 30 may further include a manifold 33, which is disposed about the upstream casing 321 and formed to define a fuel inlet 330 and an interior into which a fuel supply may be provided.

As shown in FIG. 2, the pair of premixing passages 90 may be disposed circumferentially adjacent to one another with a circumferential distance between them that is similar to a diameter of the corresponding one of the multiple injectors 40. Each of the pair of the premixing passages 90 extends substantially in parallel and in an axially downstream direction along a length of the downstream casing 322. Each of the pair of the airway openings 80 is defined at or near an upstream end of a corresponding one of the premixing passages 90 and has, for example, an elongate shape with a length that is substantially similar to a width of the associated premixing passage 90. A main one of the fuel feeds 70 may be disposed to extend from the manifold 33 in an axially downstream direction along a length of the upstream casing 321 at a circumferential location that is generally between the premixing passages 90. Fluid couplings 71 extend transversely from a downstream end of the fuel feed 70 to the premixing passages 90 downstream from the airway openings 80. Additional fuel feeds 70 may be disposed proximate to the main one of the fuel feeds 70 along with additional fluid couplings 71. In this way, at least one to three fuel feed(s) 70 may be provided for each one of the multiple injectors 40.

In an operation of the turbomachine component 10, fuel may be fed to the fuel feeds 70 by way of the fuel inlet 330 of the manifold 33. The fuel is then transported axially downstream by the fuel feeds 70 to the premixing passages 90. Within the premixing passages 90, the fuel is mixed with CDC air entering the premixing passages 90 by way of the airway openings 80. The resulting fuel and air mixture is then transported axially downstream along the premixing passages 90 to the plenums 100 at which the fuel and air mixture is communicated into the multiple injectors 40. The multiple injectors 40 then inject the fuel and air mixture into the second interior 220 and the main flow of the products of the combustion.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A flowsleeve of a gas turbine combustor, the flowsleeve comprising:

an annular body including an upstream casing and a downstream casing, the upstream casing defining a first fuel feed, a second fuel feed and a third fuel feed, and the downstream casing defining a first airway opening and a second airway opening, and a first premixing passage and a second premixing passage, the first airway opening being disposed on a wall forming the first premixing passage, and the second airway opening being disposed on a wall forming the second premixing passage, and the first fuel feed having a first fuel coupling with the first premixing passage, the second fuel feed having a second fuel coupling with the second premixing passage, the third fuel feed having a third fuel coupling with the first premixing passage and a fourth fuel coupling with the second premixing passage, the first and second premixing passages receive fuel and air, forming a fuel-air mixture, from their respective first, second and third fuel feeds and their respective first and second airway openings.

2. The flowsleeve according to claim 1, wherein the upstream casing and the downstream casing correspondingly define the first, second and third fuel feeds, the first and second airway openings, and the first and second premixing passages, respectively, at multiple circumferential locations.

3. The flowsleeve according to claim 2, wherein the first, second and third fuel feeds are defined at each of the multiple circumferential locations.

4. The flowsleeve according to claim 2, wherein the first and second airway openings and the first and second premixing passages are respectively defined at each of the multiple circumferential locations as respective pairs thereof.

5. The flowsleeve according to claim 1, wherein the first, second and third fuel feeds are oriented along an axial direction and the air provided from the first and second airway openings comprise compressor discharge air and flows through the first and second airway openings in an inward radial direction.

6. The flowsleeve according to claim 1, wherein the downstream casing defines each of the first and second airway openings with an elongate shape, which has an elongate length thereof oriented in a circumferential direction, a width of each of the first and second premixing passages being defined in the circumferential direction and being substantially similar to the elongate length of each of the first and second airway openings, respectively.

7. The flowsleeve according to claim 1, wherein the downstream casing further defines a plenum at a downstream end of the first and second premixing passages.

8. The flowsleeve according to claim 1, further comprising a manifold disposed about the upstream casing to define a fuel inlet coupled to the first, second and third fuel feeds.

9. The flowsleeve according to claim 1, wherein the downstream casing is welded to the upstream casing.

10. A gas turbine combustor, comprising:

a first vessel having an upstream end defining a first interior in which combustion occurs and a downstream end defining a second interior through which products of combustion flow;

a second vessel configured to be disposed about the downstream end of the first vessel, the second vessel defining a first fuel feed, a second fuel feed and a third fuel feed, a first airway opening and a second airway opening, and a first premixing passage and a second premixing passage, the first airway opening being disposed on a wall forming the first premixing passage, and the second airway opening being disposed on a wall forming the second premixing passage, and the first fuel feed having a first fuel coupling with the first premixing passage, the second fuel feed having a second fuel coupling with the second premixing passage, the third fuel feed having a third fuel coupling with the first premixing passage and a fourth fuel coupling with the second premixing passage, the first and second premixing passages each having a passage interior in which fuel and air, receivable from the first, second and third fuel feeds and the first and second airway openings, respectively, are combinable to form a fuel-air mixture; and an injector coupled to the first and second premixing passages, and configured to transport the fuel-air mixture to the second interior.

11. The gas turbine combustor according to claim 10, wherein the first vessel and the second vessel define an annulus therebetween, which is traversed by the injector.

12. The gas turbine combustor according to claim 10, wherein the injector is plural in number, the plural injectors being arrayed about the second interior.

13. The gas turbine combustor according to claim 10, wherein each of the first, second and third fuel feeds is oriented along an axial direction and the air provided from the first and second airway openings comprise compressor discharge air and flows through the first and second airway openings in an inward radial direction.

14. The gas turbine combustor according to claim 10, wherein each of the first and second airway openings is defined with an elongate shape, which has an elongate length thereof oriented in a circumferential direction, a width of each of the first and second premixing passages being defined in the circumferential direction and being substantially similar to the elongate length of each of the first and second airway openings, respectively.

15. The gas turbine combustor according to claim 10, wherein the second vessel is formed to define a plenum at a downstream end of the first and second premixing passages, the injector being fluidly coupled to the plenum.

16. The gas turbine combustor according to claim 10, wherein the second vessel comprises:

a downstream casing in which the first and second airway openings and the first and second premixing passages are defined;

an upstream casing in which the first, second and third fuel feeds are defined; and a manifold disposed about the upstream casing to define a fuel inlet coupled to the first, second and third fuel feeds.

17. The gas turbine combustor according to claim 16, wherein the downstream casing is welded to the upstream casing.

18. A gas turbine combustor, comprising:

a first vessel having an upstream end defining a first interior in which combustion occurs and a downstream end defining a second interior through which products of combustion flow;

a second vessel configured to be disposed about the downstream end of the first vessel, the second vessel defining at multiple circumferential locations:

a first fuel feed, a second fuel feed and a third fuel feed, a first airway opening and a second airway opening, a first premixing passage and a second premixing passage, the first airway opening being disposed on a wall forming the first premixing passage, and the second airway opening being disposed on a wall forming the second premixing passage, and the first fuel feed having a first fuel coupling with the first premixing passage, the second fuel feed having a second fuel coupling with the second premixing passage, the third fuel feed having a third fuel coupling with the first premixing passage and a fourth fuel coupling with the second premixing passage, wherein each of the first, second, third and fourth fluid couplings being disposed downstream from the first and second airway openings, respectively, each of the first and second premixing passages having a passage interior in which fuel and air, receivable from the first, second and third fuel feeds, respectively, are combinable downstream from the first and second airway openings to form a fuel and air mixture, and a plenum at a downstream end of the premixing passage; and multiple injectors, each of the multiple injectors being coupled to the plenum and configured to transport the fuel and air mixture to the second interior.

* * * * *